United States Patent [19]

Johansson et al.

[11] Patent Number: 4,911,077

[45] Date of Patent: Mar. 27, 1990

[54] METHOD FOR PRODUCING PROPELLANT CHARGES AND CHARGES PRODUCED ACCORDING TO THIS METHOD

[75] Inventors: Lennart Johansson; Mats Olsson; Torsten Persson, all of Karlskoga, Sweden

[73] Assignee: Nobel Kemi AB, Karlskoga, Sweden

[21] Appl. No.: 233,795

[22] Filed: Aug. 19, 1988

[30] Foreign Application Priority Data

Aug. 21, 1987 [SE] Sweden ..... 8703247

[51] Int. Cl.[4] ..... C06B 45/00

[52] U.S. Cl. ..... 102/289; 102/292

[58] Field of Search ..... 102/288–292

[56] References Cited

U.S. PATENT DOCUMENTS 4,386,569 6/1983 Deas ..... 102/291 X 4,654,093 3/1987 Bolinder et al. ..... 102/291 X

*Primary Examiner*—Peter A. Nelson

*Attorney, Agent, or Firm*—Pollock, Vande Sande & Priddy

[57] ABSTRACT

The disclosure relates to a method of producing charges for cannons with extremely high charge density and favorable burning properties from the standpoints of both wear and pressure vs time characteristics. According to the invention, the charge is formed of mutually parallel, bundled tubular propellant rods which have been provided with specially designed rupture points which cause the charge to be ignited as a pure tubular propellant charge of large length in relation to the diameter of the combustion channels, but finally burns as a pure granular propellant. The disclosure also relates to propellant charges produced according to the disclosed method.

15 Claims, 1 Drawing Sheet

METHOD FOR PRODUCING PROPELLANT CHARGES AND CHARGES PRODUCED ACCORDING TO THIS METHOD

TECHNICAL FIELD

The present invention relates to a method for producing propellant charges for cannons in which the propellant acts, in the ignition phase as tubular propellant sticks of considerable length in relation to the diameter of its inner combustion channels, but, on continued combustion, acts as a loosely disposed tubular grain propellant of short length, which results in charges which expose the barrel to a relatively slight degree of wear. The present invention also makes possible the production of charges of extremely high charge weight. The present invention also relates to charges produced according to the method as disclosed above.

BACKGROUND ART

In this art, it has always previously been considered extremely difficult to combine high charge densities of propellant charges with the best possible burning properties of the charge. Charges have long been manufactured from bundled single or multi-perforated propellant sticks in full charge length, in which each propellant stick is as long as the entire charge and in which the sticks are packed together in parallel to form dense bundles. The ignition of such a charge presents no problem. On the contrary, such ignition is readily effected along the channels and outer sides of the propellant sticks as long as these are not coated with inhibitor. However, practically all of the propellant combustion will, in such a charge, take place in the cartridge chamber of the weapon, or in its immediate vicinity, which gives rise to extreme local wear on the barrel. Moreover, the pressure which the combustion gases give rise to within the long propellant tubes must be prevented from becoming so high that the propellant tubes, after a certain burn time, are split throughout their entire length and shattered into small fragments. In such an event, this gives rise to a relatively large instantaneous increase in the burning surface of the powder, which may result in a very high pressure elevation in the barrel which, in its turn, may naturally have disastrous effects upon the barrel itself. The holes or channels in the propellant tubes for such charges must, therefore, be made quite large, thus reducing the possibility of attaining high charge density and, in addition, reducing the progressivity of a multi-perforated propellant.

One attempt to avoid the effects briefly outlined above is disclosed in U.S. PS No. 660.567, dating from 1900, in which the inventor Gathmann proposes providing multi-hole, tubular propellant of long length with evenly spaced gas outlets in order to prevent the propellant tubes from being fragmented during the process of combustion. According to this patent, the gas outlets have been given the form of V-shaped broad grooves which are positioned alternately on opposing sides and extend at least past the center of the propellant tube. By such means the longitudinal channels of the propellant tube will be placed in communication with at least every second gas outlet. With this design, the inventor claims to be able to ensure that the propellant tubes will be kept whole throughout the combustion process and will not become fragmented. The inventor also claims to be able to achieve particular effects by varying the size of the grooves along the propellant rods. By such means, the inventor claims to be able to produce propellant charges which may be given uniform distribution throughout the volume of the charge chamber and which do not run the risk of becoming gathered together either at the front or at the rear, which could give rise to undesirable pressure peaks while the charge is burning.

However, we have long been aware of the fact that propellant charges consisting of loose tubular or rod-shaped propellant divided up into short lengths, so-called grain powder, most often impart to the charge the most highly advantageous burning properties and at the same time cause the least barrel wear. The reason for this is that loosely disposed powder in the propellant charge for cannons will, on combustion of the charge, in the main accompany the propellant gases and the projectile out into the barrel during successive combustion. This makes for considerably lower levels of local wear on the barrel in the critical zone immediately ahead of the charge chamber. At the same time short lengths of the propellant obviate the problems of fragmentation of the propellant tubes and consequential undesirable pressure peaks in the barrel. On the other hand, a desired pressure elevation in a charge of loosely disposed powder may be controlled, to a favorable point in time during the combustion process, by selecting single- or multi-perforated propellant of suitable hole diameter, possibly supplemented with a surface inhibition provided in a known manner. The disadvantage inherent in the loosely disposed grain powder is its considerable bulk and space requirement, since each grain of powder will then lie randomly oriented. Moreover, such loose powder charges require long ignitor tubes, or other types of igniting agents, extending along at least a portion of the charge and ensuring an instantaneous total ignition throughout a major part of the charge.

Otherwise, it is conceivable that the overall ignition of the charge will be uneven due to the high and uneven resistance to gas flow between the powder grains. In order to produce propellant charges of the same charge density as that which can be attained using bundled tubular propellant sticks of full charge length, but with the same burn properties as those which are attained in charges of loosely disposed tubular or rod-shaped granular propellant divided into smaller lengths, attempts have been made in this art to produce charges in which powder of the latter type has more or less manually been stacked, side by side, in layers one above the other. These charges have, functioned satisfactorily, but they are extremely expensive to produce manually and extremely difficult to produce by machine. Another method of increasing the performance of artillery pieces without recourse to a new design with room for larger propellant charges would then be to change to a propellant of higher force which, in its turn, automatically increases the level of wear on the barrel in a manner which is often unacceptable.

We have, however, now discovered that it is actually possible to produce propellant charges in which the propellant powder, on initiation, acts as a tubular propellant of large length in relation to the diameter of the combustion channel, quite simply because it then consists of such a propellant, but, after a brief interval in the continued combustion process, acts in the same manner as rod-shaped or tubular granular propellant divided up into short lengths, quite simply because it then consists of such granular propellant. The very fact that these charges may, moreover, be made with extremely high charge weights is a further advantage.

The solution to the problem has proved to be to form the charge of mutually parallel, tightly packed, single- or multi-hole tubular propellant rods, which, prior thereto, have been provided, at predetermined separations, with perforations from the outside of the propellant tubes to all of their longitudinal channels and preferably transversally through the propellant tube. These perforations may be effected either transversally through the center of the propellant tubes such that they cover all of the combustion channels of the propellant and leave a certain amount of propellant intact on either side of the perforations, which makes for the desired cohesion of the tubular propellant rods up to the instant of initiation, or alternatively, pairwise from opposite sides of the tubular propellant rods at a slight displacement from one another, such that they partially overlap. In the latter case each one covers but a part of the combustion channels of the propellant.

One essential difference in relation to the abovementioned U.S. patent is that we have found these perforations should be made without the removal of any material, such that the perforations will, at the moment of initiation, function as localized weak-points in the propellant tubes, rather than as gas outlets. The result will be that, because of the inner excess pressure of the combustion gases, the propellant tubes will, at a very early stage, become fragmented and thus form a grain propellant of a predetermined configuration. The weakening at each perforation must, therefore, be sufficiently large for the propellant tube to break completely at the perforations rather than become split along the propellant combustion channels. A suitable spacing between these perforations has been found to be between 10 and 100 times the inner diameter of the propellant tubes, i.e. the diameter of the combustion channels. Since each perforation should cover all longitudinal channels in the tubular propellant which may, for example, have 1-, 7-, 19- or 37-holes, or some other suitable number of channels, it is a distinct advantage to provide the perforations in such a manner that a sufficient amount of propellant is left on either side of the perforations in order that the propellant tue retain a sufficient inherent rigidity so as not to break up during both forming and handling of the charge. In propellant tubes of a length exceeding 100 times the diameter of their combustion channels, measures must be taken to ensure that the propellant tubes, on initiation, do not become fragmented in an uncontrolled manner. This problem may, in certain cases, occur even when powder tubes are of a length which is just above 10 times the diameter of the combustion channels. The propellant length which, in each individual case, gives rise to such uncontrollable combustion must thus be considered as excessive in this context. Thus, the term tubular propellant of considerable length in relation to the diameter of the combustion channels is here taken to mean lengths in excess of between 10 and 100 times the diameter of the combustion channels. One result of the dense packing of the propellant which we have succeeded in achieving in this way is that we have been able to pack wear-reducing "Swedish additive" in a modification of one of our older charges without needing, by compensation, to reduce weapon performance or increase the force of the propellant. On the contrary, the modified charge displays considerably better performance, whilst the wear-reducing additive has reduced barrel wear in a highly satisfactory manner.

The perforation of the tubular propellant rods may readily be executed in conjunction with the final shaping of the propellant by extrusion through a die. An automatic device for perforating the propellant tubes at predetermined separations can be provided in conjunction with the outlet side of the die, or elsewhere. In conjunction herewith, means for surface inhibition of the propellant tubes may be incorporated in those cases where it is desirable to produce a surfaceinhibited propellant with increased progressivity. Propellant charges according to the invention, wholly or partly consisting of surface-inhibited, progressive propellant are thus easy to produce. In this context, the present invention is highly relevant to this art, since a surface-inhibited propellant requires, as a rule, high charge rates in order to be fully effective. Charges of this type which have been subjected to tests have also proved to function highly satisfactorily. The surface inhibition may, depending upon the inhibitor, the coating method and the like, be effected either before or after the perforation.

BRIEF DESCRIPTION OF THE ACCOMPANYING DRAWINGS

The present invention has been defined in the appended claims and will now be described in greater detail below with reference to a number of drawings.

DESCRIPTION OF PREFERRED EMBODIMENT

Figure 1:
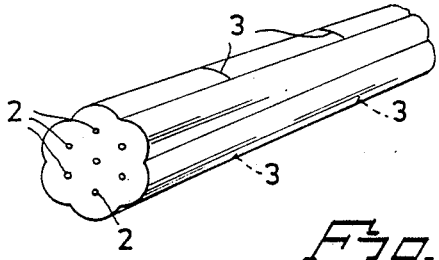
FIG. 1 shows an oblique projection of a rosette-shaped, tubular propellant rod perforated with 7 holes.
Figure 3:
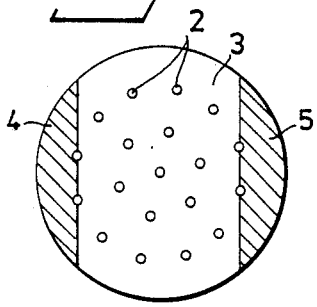
FIG. 3 shows a perforation through a cylindrical 19-hole propellant rod.
Figure 2:
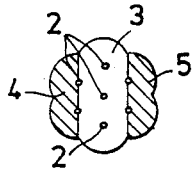
FIG. 2 is a cross-section at one of the perforations through the propellant rod according to FIG. 1.

Referring to the drawings, on which corresponding parts have been given the same reference numerals irrespective of the different scales on the figures, reference numeral 1 indicates a perforated 7-hole propellant in which the longitudinal propellant channels are designated 2 and the perforations are designated 3. As has already been pointed out, the perforations entail that no propellant material whatsoever has been removed. The perforations 3 may be better described as through incisions, each of which cover all of the 7 longitudinal combustion channels 2 of the tubular propellant but leave a certain portion 4, 5 of the tubular propellant walls intact on either side of the incision (see FIG. 2). FIG. 3 shows a corresponding perforation through a cylindrical 19-hole propellant.

Figure 4:
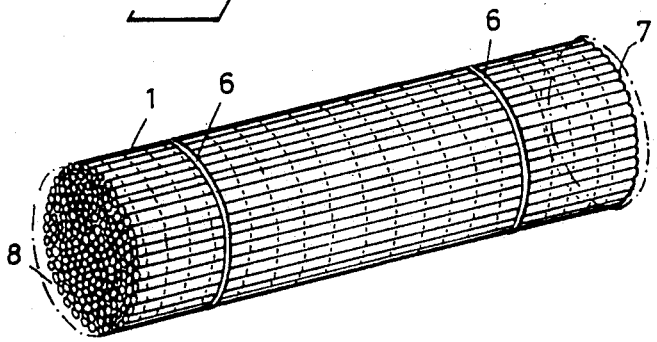
FIG. 4 shows a finished charge on another scale.
Figure 5:
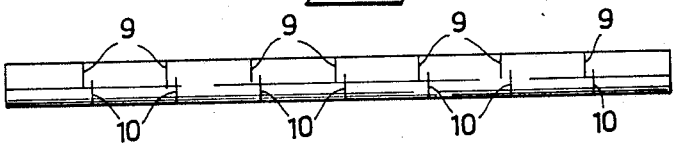
FIG. 5 shows one alternative to the perforation.

The charge illustrated in FIG. 4 consists of a number of perforated tubular propellant rods 1 of full charge length which have been bundled together by means of combustible bands 6 and which may, for example, be passed down into a case or provided with a surrounding powder bag. If desired, the charge may also be provided with a base initiation charge 7 and be supplemented with outer protection 8. According to the embodiment shown in FIG. 5, the perforations are in the form of two incisions 9 and 10 which, from either side, depart from the outer edge of the propellant tube 1 and reach somewhat beyond its central plane. Furthermore, the incisions should be so close to one another that the "propellant bridge" between them breaks easily upon initiation in the cannon but are not close enough, that the tubes can not be handled without breaking. Hence, the basic concept is that the propellant on total initiation, should break along the incisions rather than that the tubular propellant wall should become fragmented.

Figure 6:
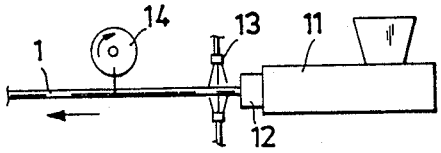
FIG. 6 illustrates a general arrangement for producing perforated propellants according to the invention.

Finally, FIG. 6 shows a general apparatus for producing perforated, surface-inhibited tubular propellant. The figure shows a screw extruder 11 provided with a matrix or die 12 through which the finished propellant 1 is extruded. Immediately after the extruder, there is a device 13 for surface inhibition of the propellant by a suitable substance, followed by a second device 14 for perforating the tubular propellant at predetermined separations. Perforation of the entire length of the tubular propellant may also be affected by simultaneous use of a plurality of cooperating perforators.

The present invention should not be considered as restricted to that described above and shown on the drawings, many modifications being possible without departing from the spirit and scope of the appended claims.

What we claim and desire to secure by Letters Patent is:

1. A method of producing propellant charges, comprising the steps of:

providing a plurality of tubular propellant rods, each rod having at least one combustion channel therein extending in the lengthwise direction, said rods having a length substantially greater than the diameter of said combustion channel;

making a plurality of slits without removal of propellant material in each of said rods at predetermined intervals along the length of said rods, said slits extending from the surface of each of said rods into said rod substantially transversely with respect to said at least one combustion channel and crossing said combustion channel; and binding said plurality of tubular rods in a parallel relationship to form a propellant charge.

2. The method as claimed in claim 1, wherein each slit extends transversely through said propellant rod and has a sufficient width to pass through all of said longitudinally-extending combustion channels provided in said propellant rod.

3. The method as claimed in claim 1, wherein said slits of said propellant rods are formed in such a manner that a sufficient amount of propellant material is available on either side of said slit to maintain the unity of the tubular propellant rod, while this amount of propellant material is nowhere of such a thickness that breaking at the weakened points in said rod is superseded by complete shattering of the walls.

4. The method as claimed in claim 1, wherein said slits are formed as pairwise, proximally-disposed sections departing from opposing surfaces of said propellant rod, the smallest distance between the sections amounting to between 0.1 and 0.5 times the maximum outer dimensions of said rod in a cross-section.

5. The method as claimed in claim 1, wherein said tubular propellant rods are, prior to binding into complete propellant charges, surface treated with a surface inhibition agent.

6. The method as claimed in claim 5, wherein both said slits in said propellant rods and the surface inhibition are effected in conjunction with the production of the tubular propellant by extrusion in a matrix or die.

7. The method as claimed in claim 1, wherein said slits are provided at intervals corresponding to a distance from about 10 to 100 times the diameter of the longitudinally-extending combustion channels of the propellant rods.

8. The method as claimed in claim 2, wherein said slits are provided at intervals corresponding to a distance from about 10 to 100 times the diameter of the longitudinally-extending combustion channels of the propellant rods.

9. The method as claimed in claim 5, wherein said slits are provided at intervals corresponding to a distance from about 10 to 100 times the diameter of the longitudinally-extending combustion channels of the propellant rods.

10. A propellant charge comprising:

a plurality of densely packed, parallel, single or multichannel tubular propellant rods, each of said rods including at least one combustion channel extending therethrough in the lengthwise direction, said rods having their length substantially greater than the diameter of said at least one combustion channel;

a plurality of slits provided in each of said rods along their length at predetermined intervals, said slits extending from a surface of said rod and into said rod substantially transversely with respect to its length and crossing through said combustion channels, each of said slits having a width such as to leave a sufficient amount of propellant material on either side of said propellant rod to maintain a unity of said propellant rod.

11. The propellant charge according to claim 10, wherein said intervals correspond to a distance from about 10 to 100 times the diameter of said combustion channel.

12. The propellant charge as claimed in claim 10, wherein each slit is in the form of a through-section which passes transversely through said tubular propellant rods from their one surface to the other one and leaves but one propellant wall on either side of the slit.

13. The propellant charge as claimed in claim 10, wherein said tubular propellant rods are surface-inhibited.

14. The propellant charge as claimed in claim 11, wherein said tubular propellant rods are surface-inhibited.

15. The propellant charge as claimed in claim 10, wherein said slits are formed as pairwise, proximally-disposed sections departing from opposing surfaces of said propellant rod, the smallest distance between the sections amount to between 0.1 and 0.5 times the maximum outer dimensions of said rod in a cross-section.

* * * * *